US009708032B2

(12) United States Patent
Ruostemaa et al.

(10) Patent No.: US 9,708,032 B2
(45) Date of Patent: Jul. 18, 2017

(54) METHOD FOR DISASSEMBLING AND/OR ASSEMBLING AN UNDERWATER SECTION OF A RETRACTABLE THRUSTER UNIT

(71) Applicant: Rolls-Royce Oy Ab, Rauma (FI)

(72) Inventors: Esa Ruostemaa, Eurajoki (FI); Mikko Karppinen, Rauma (FI); Mikko Knuuti, Rauma (FI)

(73) Assignee: ROLLS-ROYCE OY AB, Rauma (FI)

( * ) Notice: Subject to any disclaimer, the term of this patent is extended or adjusted under 35 U.S.C. 154(b) by 282 days.

(21) Appl. No.: 14/652,075

(22) PCT Filed: Dec. 14, 2012

(86) PCT No.: PCT/FI2012/051249
§ 371 (c)(1),
(2) Date: Jun. 12, 2015

(87) PCT Pub. No.: WO2014/091063
PCT Pub. Date: Jun. 19, 2014

(65) Prior Publication Data

US 2015/0329181 A1 Nov. 19, 2015

(51) Int. Cl.

| | |
|---|---|
| ***B63B 9/00*** | (2006.01) |
| ***B63H 5/125*** | (2006.01) |
| ***B63H 25/42*** | (2006.01) |

(52) U.S. Cl.
CPC ..... *B63B 9/00* (2013.01); *B63H 5/125* (2013.01); *B63H 25/42* (2013.01); *B63H 2025/425* (2013.01); *Y10T 29/49819* (2015.01)

(58) Field of Classification Search
CPC ..... B63B 17/0018; B63B 2009/007; B63H 5/125; B63H 20/08; B63H 2020/008;
(Continued)

(56) References Cited

U.S. PATENT DOCUMENTS 4,036,163 A * 7/1977 Pehrsson ..... B63B 9/00 114/151
4,046,096 A * 9/1977 Liaaen ..... B63B 17/0018 440/112
(Continued)

FOREIGN PATENT DOCUMENTS

JP S59145690 8/1984
JP S59220488 12/1984
(Continued)

OTHER PUBLICATIONS

Extended European Search Report for European Application No. 12890088.3, Completed by the European Patent Office, ated Oct. 7, 2016, 8 Pages.
(Continued)

*Primary Examiner* — Jason L Vaughan
(74) *Attorney, Agent, or Firm* — Brooks Kushman P.C.

(57) ABSTRACT

A method for disassembling and/or assembling an underwater section of a retractable thruster unit of a swimming vessel. A supporting cradle is detachably fixed to the underwater section from below, and the thruster unit is lifted so that the underwater section is at least partly brought inside the well formed in the bottom of the vessel. Lifting wires of an auxiliary lift are connected to the supporting cradle for supporting the thruster unit. Water is drained from the well, and the lower gear is disengaged and the intermediate section and the lower gear are sealed. After that water is let to ingress into the well and the underwater section is lowered down by the auxiliary lift to dock bottom or sea bed, from where the underwater section is picked up with a crane.

15 Claims, 4 Drawing Sheets

(58) Field of Classification Search
CPC ..... B63H 20/04; Y10T 29/49718; Y10T 29/49721; Y10T 29/4973; Y10T 29/49815; Y10T 29/49819
See application file for complete search history.

(56) References Cited

U.S. PATENT DOCUMENTS 4,066,034 A * 1/1978 Haglund ..... B63B 9/00 294/81.5
4,066,035 A * 1/1978 Haglund ..... B63B 9/00 294/81.5
4,573,929 A 3/1986 Savikurki et al.
4,586,907 A * 5/1986 Florander ..... B63B 17/0018 440/112
4,634,389 A * 1/1987 Eptaminitakis ..... B63B 9/00 440/53
4,696,650 A 9/1987 Haglund
5,277,632 A * 1/1994 Davis ..... B63H 5/165 29/402.01
5,435,762 A * 7/1995 Reuter ..... B63B 17/0018 440/54
6,067,697 A 5/2000 Savikurki et al.
7,641,526 B1 * 1/2010 Bekker ..... B63H 5/125 440/54
7,992,275 B1 8/2011 Bekker et al.
8,715,021 B2 * 5/2014 Horkko ..... B63H 5/125 440/54
8,926,382 B2 * 1/2015 Van Der Kam .... B63B 17/0018 440/54
9,440,708 B2 * 9/2016 Van Der Kam .... B63B 17/0018
2012/0058694 A1 3/2012 Krautkramer

FOREIGN PATENT DOCUMENTS

JP S6192989 5/1986
JP S62139782 6/1987
JP S62191598 12/1987
JP 2000142583 5/2000
KR 20090101989 9/2009
WO 9727102 7/1997
WO 2005100151 10/2005
WO 2009126097 10/2009
WO 2011127987 10/2011

OTHER PUBLICATIONS

International Search Report for PCT/FI2012/051249, Completed by the Finnish Patent Office on Jun. 24, 2013, 4 Pages.

* cited by examiner

METHOD FOR DISASSEMBLING AND/OR ASSEMBLING AN UNDERWATER SECTION OF A RETRACTABLE THRUSTER UNIT

CROSS-REFERENCE TO RELATED APPLICATION

This application is the U.S. national phase of PCT Application No. PCT/FI2012/051249 filed on Dec. 14, 2012, the disclosure of which is incorporated in its entirety by reference herein.

TECHNICAL FIELD OF THE INVENTION

The present invention relates to a method for disassembling and/or assembling an underwater section of a retractable thruster unit of a swimming vessel. The invention is specifically directed to a method for disassembling and/or assembling an underwater section of an azimuthing retractable thruster unit comprising an upper gear connected to a power source, an underwater section including a lower gear connected to the actual propeller, and a vertical steering tube connecting the upper gear with the underwater section and containing a vertical shaft through which power and torque are transmitted from the upper gear to the lower gear.

BACKGROUND OF THE INVENTION

A thruster unit described above is normally mounted in a swimming vessel so that at first a well is formed in the bottom of said vessel. The well is open downwards but the top of the well is provided with a covering plate by which the well is sealed and closed upwards. The upper gear of the thruster unit is placed above the covering plate which is provided with a sealed lead-in through which the vertical steering tube extends from the upper gear to the underwater section of the thruster unit. The well is conventionally dimensioned so that the underwater section of the thruster unit fits into it. Thereby, if necessary, the thruster unit can be lifted so that the underwater section is completely retracted into the well above the bottom of the vessel.

From time to time the thruster unit needs maintenance and repairs and in some cases it has to be replaced by another thruster unit. In prior art cases in which the thruster unit has to be removed for maintenance or repairs the vessel has normally been brought to dry dock in which it has been possible to execute this kind of maintenance and replacement work. Dry docking of a vessel is extremely expensive because the work itself on a dry dock is expensive and the preparations for taking a vessel to a dry dock are time consuming. Out-of-service time of a large vessel may become quite long and that costs money. Therefore, attempts have been made to get this dead time shorter and to make it possible to get the maintenance and repair work done without bringing the vessel to a dry dock.

Publication WO 2011/127987 describes a mounting method of thruster in which method the maintenance and replacement work is carried out as "dry work" so that the thruster unit is hoisted up through a well or a hoisting chamber onto the deck of the vessel or into a dry maintenance space in which necessary maintenance and repairs are to be done.

Publication WO 97/27102 describes method and apparatus for removing a propeller assembly from and for mounting the same in an opening in the bottom of a swimming vessel. According to this publication the vessel is provided with a watertight hoisting chamber extending from the bottom of the vessel to above the waterline. For maintenance the thruster unit is hoisted through the hoisting chamber from the vessel.

Publications WO 2005/100151 and WO 2009/126097 describe methods and arrangements for disassembly/assembly of tunnel thrusters. Therefore these publications are not directly comparable with the present invention. The main idea in both of these documents is that the assembly work is done as underwater work. For the disassembly/assembly a sledge is mounted in the propeller tunnel, by which sledge the thruster unit is removed and replaced. No dry docking of the vessel is needed.

SUMMARY OF THE INVENTION

The object of the present invention is to provide a method for disassembling and/or assembling an underwater section of a retractable thruster unit of a swimming vessel by which method the problems relating to prior art technique are avoided or at least minimized. The objects of the invention are achieved by the method and equipment characterized in the appended claims.

Several advantages over prior art are attainable by the present invention. The inventive method is applicable both for new building installations and for already installed thrusters. Docking is not required for preparations for the method. Because docking is not required the out-of-service time of the vessel is shorter than before and the expenses relating to the dismounting/mounting work are lower.

Further advantages, characteristic features and embodiments of the invention will come out in more detail in the following description of the invention, in which the invention is described with reference to the accompanying drawings depicting various stages of disassembling a thruster unit.

DETAILED DESCRIPTION OF THE INVENTION

Figure 1:
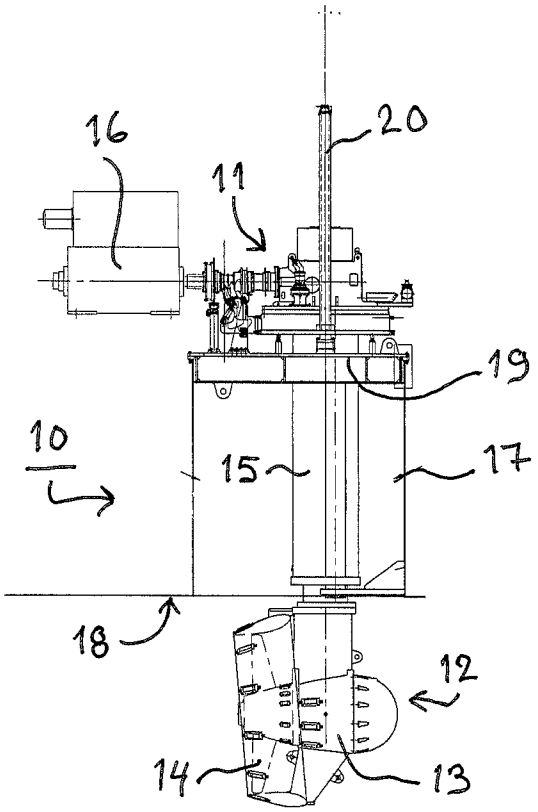
FIG. 1 is a side view of the thruster unit according to the present invention, at a stage before starting the disassembling process.

FIG. 1 shows an azimuthing thruster unit 10 which is turnable around a vertical axis for steering. The thruster unit 10 comprises an upper gear 11 connected to a power source 16, an underwater section 12 including a lower gear 13 connected to the actual propeller 14, and a vertical steering tube 15 connecting the upper gear 11 with the lower gear 13. Said steering tube 15 contains a vertical shaft through which power and torque are transmitted from the upper gear 11 to the lower gear 13.

The thruster unit 10 is mounted in a swimming vessel so that a well 17 is formed in the bottom 18 of the vessel. The well 17 is open downwards but the top of the well is provided with a covering plate 19 by which the well 17 is sealed and closed upwards. As shown in the drawings the upper gear 11 of the thruster unit 10 is placed above the covering plate 19 which is provided with a sealed lead-in through which the vertical steering tube 15 extends from the upper gear 11 to the lower gear 13 of the thruster unit 10. The well 17 is so dimensioned that in a lifted position the underwater section 12 of the thruster unit 10 comprising the lower gear 13 and the propeller 14 fits into it. The thruster unit 10 is retractable and provided with hydraulic lifting devices 20, e.g. cylinders by which the thruster unit 10 can be retracted so that the underwater section can be brought completely into the well 17 above the bottom 18 of the vessel and lowered back to the position shown in FIG. 1.

The stage depicted in FIG. 1 before the actual disassembly work is started is a preparation stage. At this stage the airtightness of the thruster unit 10 is secured. So at this stage the thruster unit 10 is made airtight if it wasn't before. Special plugging equipment is needed for making the thruster unit 10 airtight. Also the propeller 14 is locked in place. The well 17 can be filled with water at this stage.

Figure 2:
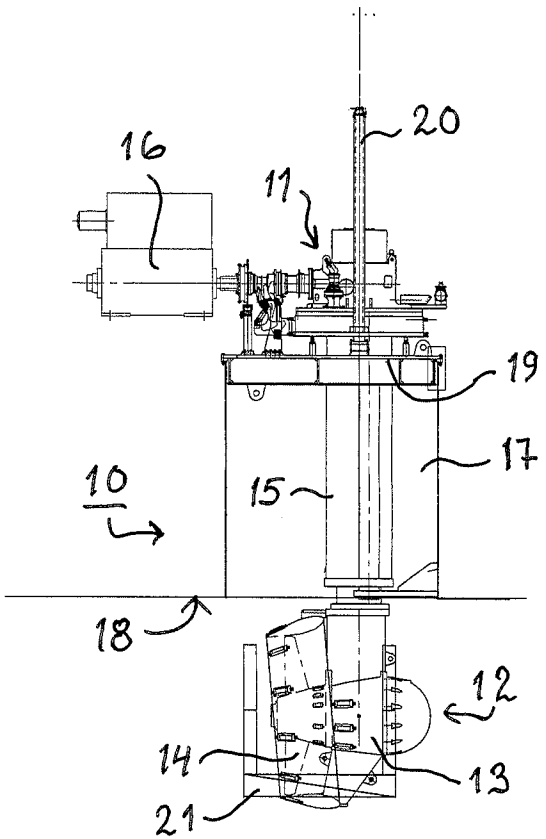
FIG. 2 shows the thruster unit at a stage in which a supporting cradle has been attached to the thruster unit.

At the stage shown in FIG. 2 a supporting cradle 21 for disassembly is fixed to the thruster unit 10. The cradle 21 on which the underwater section 12 comprising the lower gear 13 and the actual propeller 14 will be resting during the disassembly/assembly process comprises further a work platform for the divers. The cradle 21 is floated below the thruster unit 10 and into contact with the underwater section 12 and further it is fixed to said underwater section 12 by divers.

Figure 3:
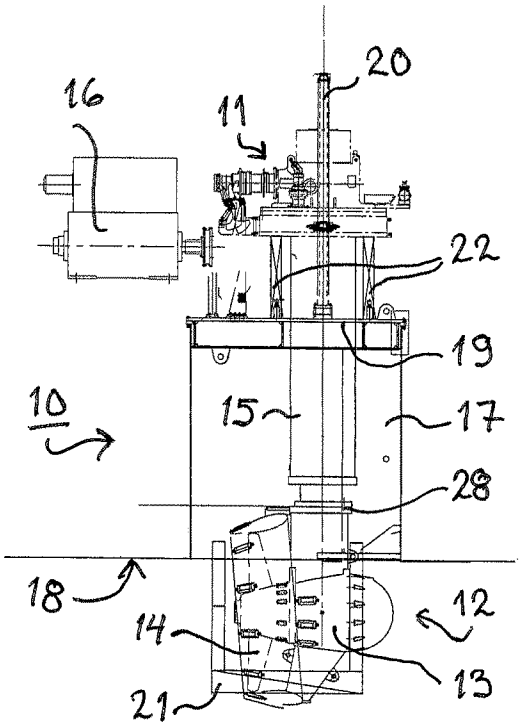
FIG. 3 shows the thruster unit in a lifted position.

FIG. 3 shows the stage in which, firstly, the gear shaft of the upper gear 11 is disengaged from between the power source 16 and the upper gear 11. Then the hydraulic lifting devices 20 have been used to lift the thruster unit 10 so that the underwater section 12 has been brought partly inside the well 17. The thruster unit 10 is mechanically locked in place in the lifted position with supports 22. Said supports 22 are arranged between the upper gear 11 and the supporting frame of the vessel. In FIG. 3 the supports are arranged between the upper gear 11 and the covering plate 19 of the well 17.

Figure 4:
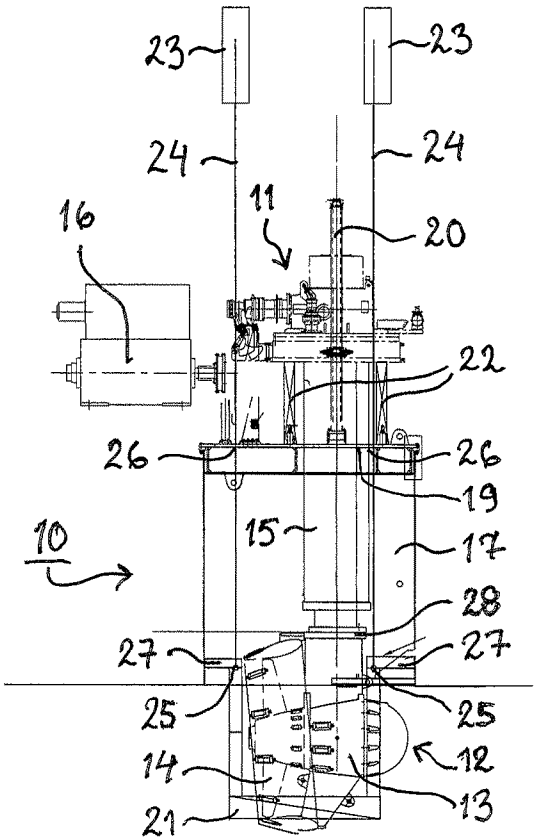
FIG. 4 shows the thruster unit in a lifted position where the auxiliary lifting means are connected and attached to the cradle.

FIG. 4 shows the thruster unit 10 in its lifted position where the auxiliary lifting means 23 are connected and attached to the cradle 21 for supporting the thruster unit 10. The auxiliary lifting means 23 are preferably jacks provided with lifting wires 24 which are connected to the underwater section 12 of the thruster unit 10. In order to maintain the underwater section 12 in balance while it is lifted there are preferably three jacks 23 with lifting wires 24. The lifting wires 24 are connected to the underwater section 12 by divers. As seen in FIG. 4 the thruster unit 10 is continuously supported in the lifted position by supports 22.

The auxiliary lifting means 23, e.g. jacks are arranged above the covering plate 19, preferably above the water line of the vessel. So the wires 24 coming from said jacks 23 must go through the covering plate 19 to reach the underwater section 12 to which they are to be connected at connection points 25. Therefore the following preparations, as presented in FIGS. 7-10, have to be made in the covering plate 19 if it was not originally assembled for this kind of operation.

Figure 9:
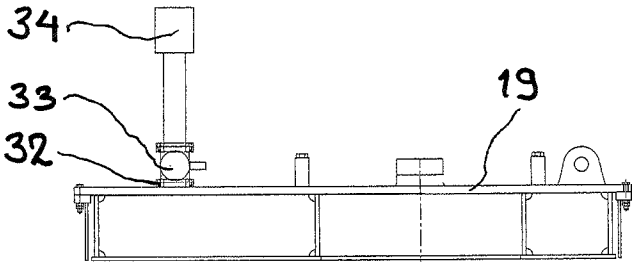
FIGS. 7-10 show the different stages of mounting of the sea valve on the cover of the well in the swimming vessel.
Figure 10:
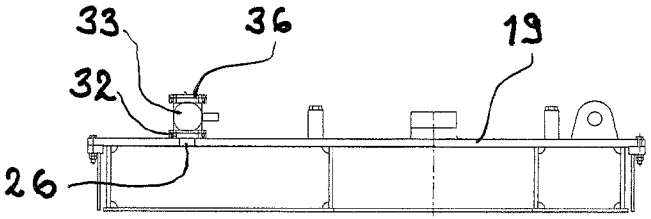
Figure 7:
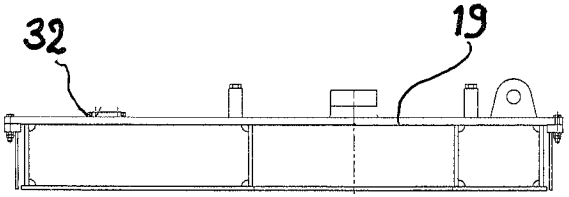
Figure 8:
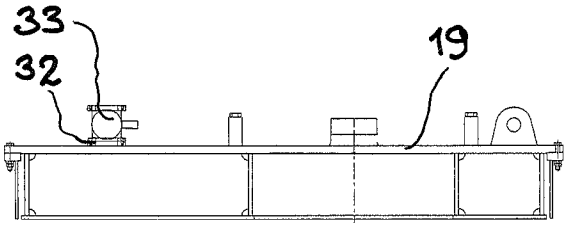

As FIG. 7 shows, at first a flange 32 for each lifting wire 24 is to be mounted and welded on the upper surface of the covering plate 19. Then, as shown by FIG. 8, a sea valve 33 is mounted on each flange 32. After that a drill 34 is mounted on the sea valve 33 and a hole 26 is drilled to the covering plate 19 through the sea valve 33. After drilling the sea valve 33 is closed and the drill 34 is removed. Then a blind flange 36 will be mounted on the sea valve 33. These steps are shown in FIGS. 9 and 10. However, if right kind of drill is not available, the holes 26 in the covering plate 19 can be made by flame cutting to rough diameter and grinded to final diameter.

Before the lifting wires 24 of the auxiliary lifting means 23 are connected to the cradle 21, pipes for the lifting wires 24 are mounted and connected to the sea valves 33. So the lifting wires 24 are running through the sea valves 33 and inside said pipes, they are not running in a free space. After these preparations the lifting wires 24 are ready to be connected to the cradle 21 at the connection points 25. In order to keep the cradle 21 with the underwater section 12 of the thruster unit 10 centered in the well 17, adjustable side guides 27 are mounted on the structure of the cradle 21. Said side guides 27 are resting against the inner wall of the well 17.

Figure 5:
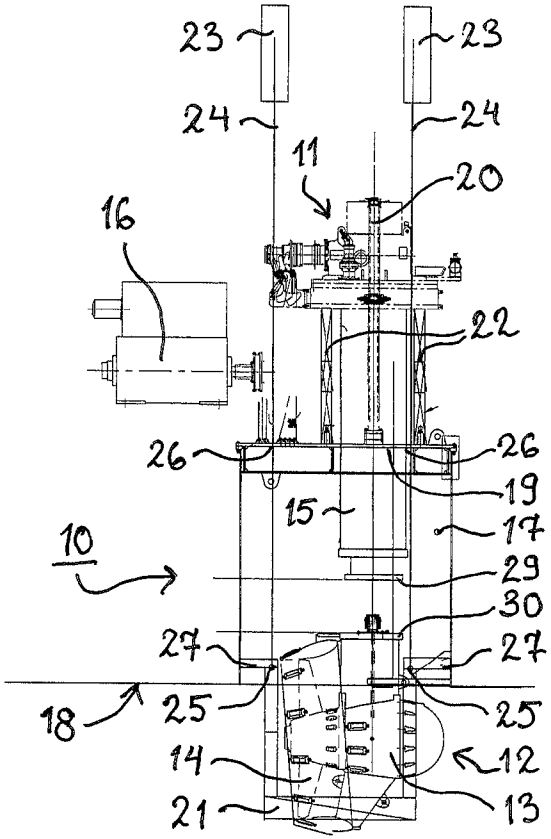
FIG. 5 shows the thruster unit at a stage in which the underwater section of the thruster unit is released.

Next, the well 17 and the input shaft of the upper gear 11 are sealed and pressurized air is supplied into the well 17. The purpose of the pressure air supply is to drain water from the well 17. After water has been drained from the well 17 the joint 28 between the lower gear 13 and the steering tube 15, i.e. the intermediate section of the thruster unit 10 is loosened. When the joint 28 has been loosened the lifting wires 24 are tightened to keep the lower gear 13 at its present place. Then the steering tube 15 with the upper gear 11 of the thruster unit 10 are lifted, so that the upper and lower flanges 29, 30 of the joint 28 are separated from each other and a space is formed between said flanges 29, 30. This is shown in FIG. 5. When an adequate space is formed between the flanges 29, 30 the steering tube 15 with the upper gear 11 are mechanically locked in place with the supports 22.

In the lifted position shown in FIG. 5 and after the joint 28 between the lower gear 13 and the steering tube 15 is loosened and the flanges 29, 30 separated from each other blinds 31 are mounted and sealed on said flanges 29, 30 of the lower end of the steering tube 15 and the lower gear 13. The purpose of this is to prevent water from getting into the steering tube 15 and the lower gear 13. Then the side guides 27 are loosened and water let to ingress into the well 17.

Figure 6:
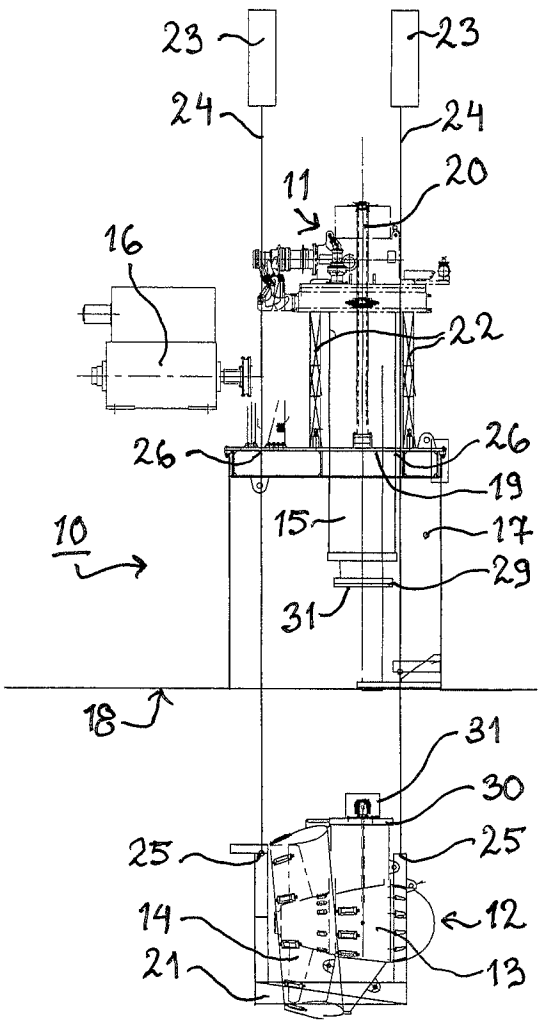
FIG. 6 shows the thruster unit at a stage in which the underwater section has been lowered down beneath the bottom of the vessel for removing it for maintenance/repair.

Finally, in FIG. 6 it is shown that the cradle 21 with the underwater section 12 of the thruster unit 10 is lowered down by the jacks 23 and the wires 24. At this stage the underwater section 12 is supported by the cradle 21 which is attached to the underwater section 12. The underwater section 12 is lowered down e.g. to the dock bottom or to sea bed. From the dock bottom or the sea bed the underwater section 12 of the thruster unit 10 can then be picked up with a crane. However, it is also possible to lift the underwater section 12 with the cradle 21 to within the range of a shore-based crane using lifting points and lifting equipment (not shown) attached to the underside of the hull of the swimming vessel. Alternatively, it is also possible to float the cradle and the underwater section 12 of the thruster unit 10 to within the range of a shore-based crane using buoyancy control. Divers will fasten the crane wires to the cradle 21 and loosen the lifting wires 24 of the jacks 23.

When the thruster unit or more precisely the underwater section 12 of the same is assembled back to its place or if a new underwater section will be assembled, the assembling process will be executed in a reverse order as explained above.

Above, the invention has been described by way of examples with reference to the exemplifying embodiments illustrated in the accompanying drawings. The invention is, however, not confined to the exemplifying embodiments shown in the drawings alone, but the invention may vary within the scope of the inventive idea defined in the accompanying claims.

The invention claimed is:

1. A method for at least one of disassembling and assembling an underwater section of a retractable thruster unit of a swimming vessel, the thruster unit including an upper gear detachably connected to a power source, said underwater section including a lower gear and a propeller, and an intermediate section with a steering tube connecting the upper gear with the underwater section, said vessel being provided with a well formed in the bottom of the vessel, into which well said underwater section can be retracted when the thruster unit is out of operation, said well being closed upwards with a covering plate, whereby in disassembling the underwater section, the method comprising the steps of:

a) fixing a supporting cradle detachably to the underwater section from below, disengaging the upper gear from the power source, and lifting the thruster unit so that the underwater section is at least partly brought inside the well and locking the thruster unit mechanically in place in the lifted position, b) connecting auxiliary lifting means provided with lifting wires to the supporting cradle for supporting the thruster unit, c) draining water from the well by supplying pressurized air into the well, d) loosening the joint between the lower gear and intermediate section of the thruster unit, e) lifting the upper gear and the intermediate section further and locking them mechanically in place while the cradle is supported in place by the auxiliary lifting means so that a space is formed between the intermediate section and the lower gear, and sealing the intermediate section and the lower gear to prevent water from getting into them, and f) letting water to ingress into the well and lowering the underwater section down by the auxiliary lifting means, attaching the wires of a crane, detaching the lifting wires of the auxiliary lifting means, and picking up the underwater section with the crane.

2. The method as claimed in claim 1, wherein sea valves are mounted on the upper face of the covering plate and holes are made in the covering plate at the sea valves, whereby the lifting wires of the auxiliary lifting means are set to run through said sea valves and holes from the auxiliary lifting means above the covering plate to the cradle.

3. The method as claimed in claim 2, wherein the holes in the covering plate are made by drilling.

4. The method as claimed in claim 3, wherein the holes in the covering plate are drilled through the sea valves.

5. The method as claimed in claim 2, wherein the holes in the covering plate are made by flame cutting to rough diameter and grinding to final diameter.

6. The method as claimed in claim 1, wherein the supporting cradle is floated below the underwater section and fixed to said underwater section by divers.

7. The method as claimed in claim 1, wherein providing supports for locking the thruster unit mechanically in place in the lifted position.

8. The method as claimed in claim 1, wherein providing the cradle with side guides and making them rest against the inner wall of the well for keeping the thruster unit centered in the well.

9. The method as claimed in claim 1, wherein providing the intermediate section and the lower gear with blinds for sealing to prevent water from getting into them, when a space is formed between the intermediate section and the lower gear.

10. The method as claimed in claim 1, wherein the underwater section with the cradle are lowered onto the dock bottom or sea bed for picking it up therefrom with the crane.

11. The method as claimed in claim 1, wherein the underwater section with the cradle are lifted to within the range of a shore-based crane, lifting equipment of which are attached to the under-side of the hull of the swimming vessel, whereby the underwater section with the cradle are picked up by said shore-based crane.

12. The method as claimed in claim 1, wherein the underwater section with the cradle are floated to within the range of a shore-based crane using buoyancy control, by which shore-based crane the underwater section with the cradle are picked up.

13. The method as claimed in claim 1, wherein the steps for fixing the supporting cradle to the underwater section, connecting the lifting wires of the auxiliary lifting means to the supporting cradle, disconnecting the lower gear from the intermediate section and sealing them, and connecting the lifting wires of the crane to the cradle are executed by divers.

14. The method as claimed in claim 1, wherein before starting at least one of the disassembly and assembly work the thruster unit is made airtight with plugging equipment and the airtightness of the thruster unit is secured.

15. The method as claimed in claim 1, wherein for assembling the thruster unit the steps of the method are executed in a reverse order to the disassembling process.

* * * * *